US008443862B1

(12) United States Patent
Manabat

(10) Patent No.: US 8,443,862 B1
(45) Date of Patent: May 21, 2013

(54) TAPE DISPENSING AID

(76) Inventor: Gregorio S. Manabat, Buena Park, CA (US)

( * ) Notice: Subject to any disclaimer, the term of this patent is extended or adjusted under 35 U.S.C. 154(b) by 0 days.

(21) Appl. No.: 13/195,816

(22) Filed: Aug. 1, 2011

Related U.S. Application Data

(60) Provisional application No. 61/400,735, filed on Aug. 2, 2010.

(51) Int. Cl.
*B29C 65/00* (2006.01)
*B32B 37/00* (2006.01)

(52) U.S. Cl.
USPC ..... 156/579; 156/527; 156/574; 156/576; 156/577; 225/25; 225/54; 225/55; 225/66; 225/77; 225/91; 242/580; 242/595.1; 242/596.1

(58) Field of Classification Search
USPC ..... 225/25, 54, 55, 66, 77, 91; 156/523, 156/527, 574, 576, 577, 579; 242/580, 595.1, 242/596.1
See application file for complete search history.

(56) References Cited

U.S. PATENT DOCUMENTS 2,401,286 A * 5/1946 Wright ..... 225/25
2,472,761 A * 6/1949 Reed ..... 225/56
2,731,084 A * 1/1956 Burns ..... 225/65
3,140,805 A * 7/1964 Seror ..... 225/66
3,260,431 A * 7/1966 Ference ..... 225/66
3,378,184 A * 4/1968 Mallory ..... 225/66
3,684,141 A * 8/1972 Hall ..... 225/65
3,904,095 A * 9/1975 Doyle ..... 225/56
4,405,068 A * 9/1983 Blair ..... 225/65
4,496,276 A * 1/1985 Shulyak ..... 225/65
5,788,807 A * 8/1998 Gratz ..... 156/577

* cited by examiner

*Primary Examiner* — Linda L Gray
(74) *Attorney, Agent, or Firm* — QuickPatents; Kevin Prince

(57) ABSTRACT

A dispensing aid is disclosed for attachment to an annular roll of tape that has an inside radial surface and an outer radial tape surface, such as a roll of masking tape for example. A pair of side risers each have at a lower end thereof an opposing, inwardly-projecting tab that is configured for sliding along the inside radial surface of the roll of tape. A top platform laterally spans the outer radial tape surface width and is fixed with an upper end of each riser. The distance between each riser may be adjustable to accommodate different tape roll widths. A cutting blade projects away from the top platform at a forward end of the platform. One of the risers may include a central slot wherein the riser is slidably engaged within the slot. The riser may include a pivot mechanism such that the riser may pivot from a vertical closed position to a horizontal open position, thereby facilitating the attachment and removal of the aid with the tape roll.

6 Claims, 6 Drawing Sheets

TAPE DISPENSING AID

CROSS-REFERENCE TO RELATED APPLICATIONS

This application claims the benefit of U.S. Provisional Patent Application 61/400,735, filed on Aug. 2, 2010, and incorporated herein by reference.

STATEMENT REGARDING FEDERALLY SPONSORED RESEARCH AND DEVELOPMENT

Not Applicable.

FIELD OF THE INVENTION

This invention relates to dispensing, and more particularly to an aid for dispensing masking tape, and the like.

DISCUSSION OF RELATED ART

Tape rolls are notoriously difficult to use without a tape dispenser, as the cut end of the tape sticks back down onto the roll and is often both difficult to locate and difficult to typically weighty in order to be robust and durable, or made of relatively cheap plastic that is prone to breakage, particularly in an environment such as a toolbox or the like. To date, no tape dispensing aid has been devices that overcomes these drawbacks, particularly for use with masking tape.

Therefore, there is a need for a device that is extremely light-weight and relatively compact, yet that provides for the easy grasping of the end of the tape and the subsequent dispensing and cutting of the tape at a desired length. Such a device would be adaptable to a variety of sizes of tape rolls and tape thicknesses, and would be intuitive and easy to use. Such a needed invention would also be relatively inexpensive to manufacture. The present invention accomplishes these objectives.

SUMMARY OF THE INVENTION

The present device is a dispensing aid for attachment to an annular roll of tape that has an inside radial surface and an outer radial tape surface, such as a roll of masking tape for example. A pair of side risers each have at a lower end thereof an opposing, inwardly-projecting tab that is configured for sliding along the inside radial surface of the roll of tape. Preferably at least one of the tabs is arched at a top surface thereof in order to accommodate the curvature of the inside radial surface of the roll. A top platform laterally spans the outer radial tape surface width and is fixed with an upper end of each riser. In one embodiment, the distance between each riser is adjustable. A cutting blade projects away from the top platform at a forward end of the platform.

In one embodiment, at least one of the risers includes a central slot, and the tab associated with such a riser is slidably engaged within the slot. Further, at least one such riser may include a pivot bar at the upper end thereof, the top platform including a pivot bar receiver for receiving the pivot bar. As such, the riser may pivot from a vertical closed position to a horizontal open position, thereby facilitating the attachment and removal of the aid with the tape roll.

The present invention is a tape dispensing aid that is extremely light-weight and relatively compact, yet provides for the easy grasping of the end of the tape and the subsequent dispensing and cutting of the tape at any desired length. The present invention is adaptable to a variety of sizes of tape rolls and tape thicknesses, and is intuitive and easy to use. Further, the present invention is relatively inexpensive to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
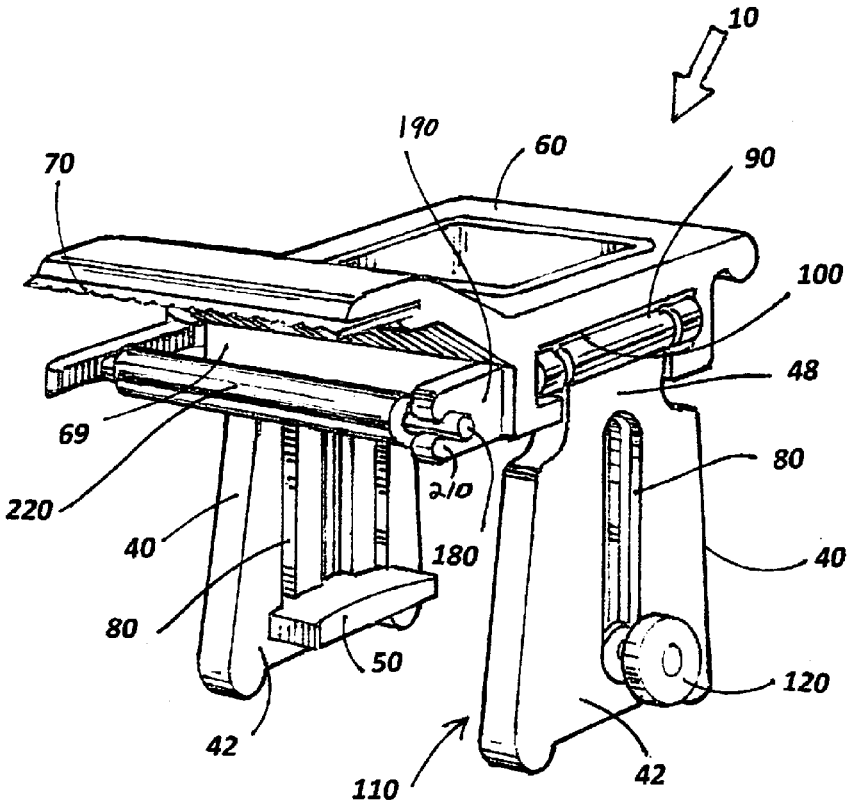
FIG. 1 is a front left perspective view of the invention.
Figure 2:
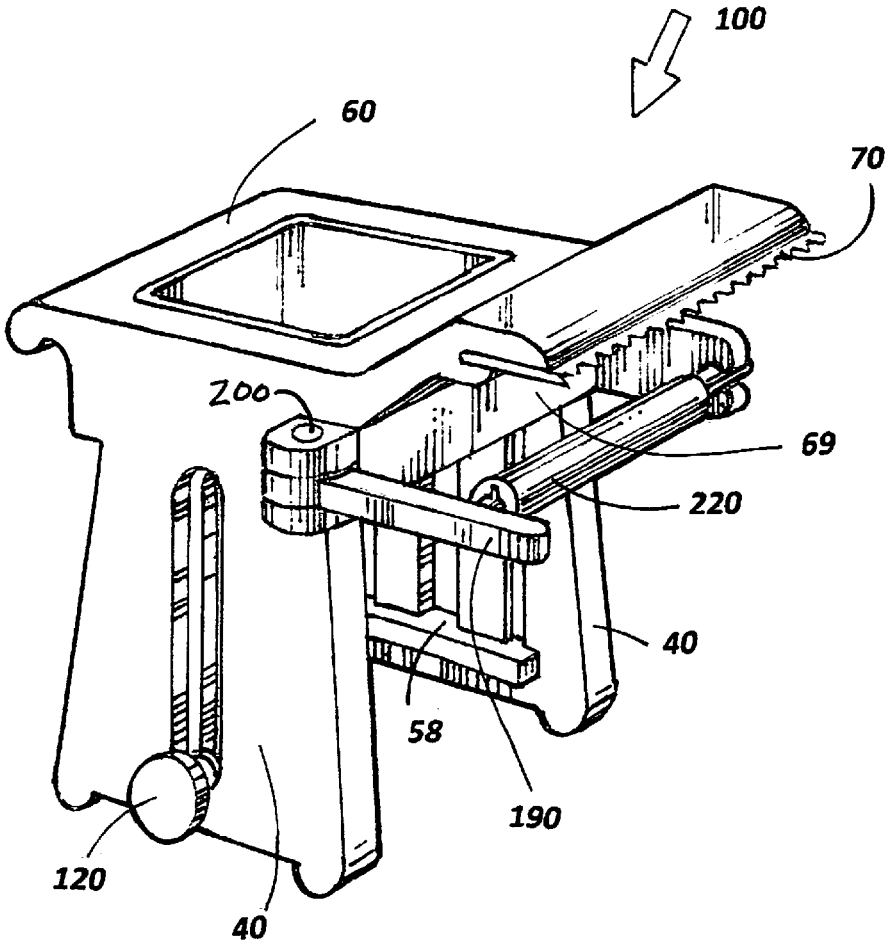
FIG. 2 is a front right perspective view of the invention.
Figure 3:
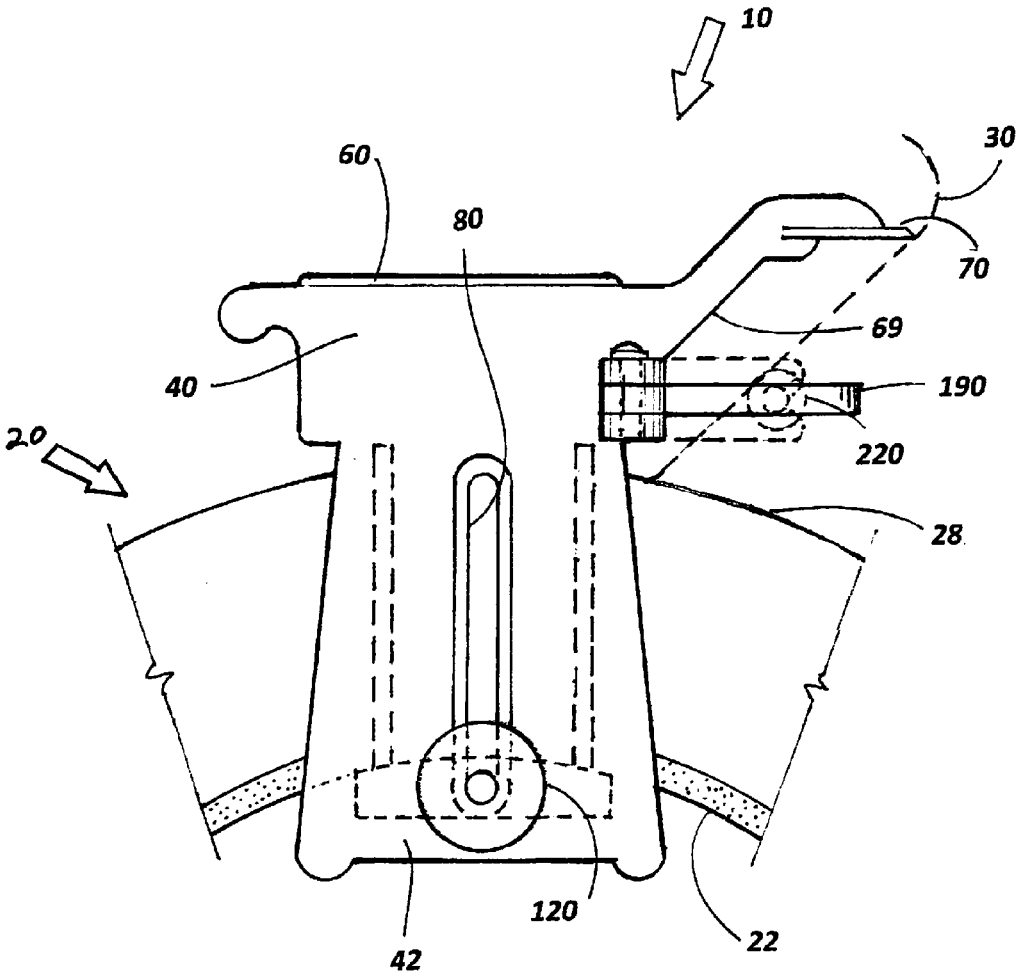
FIG. 3 is a right-side elevational view of the invention.
Figure 4:
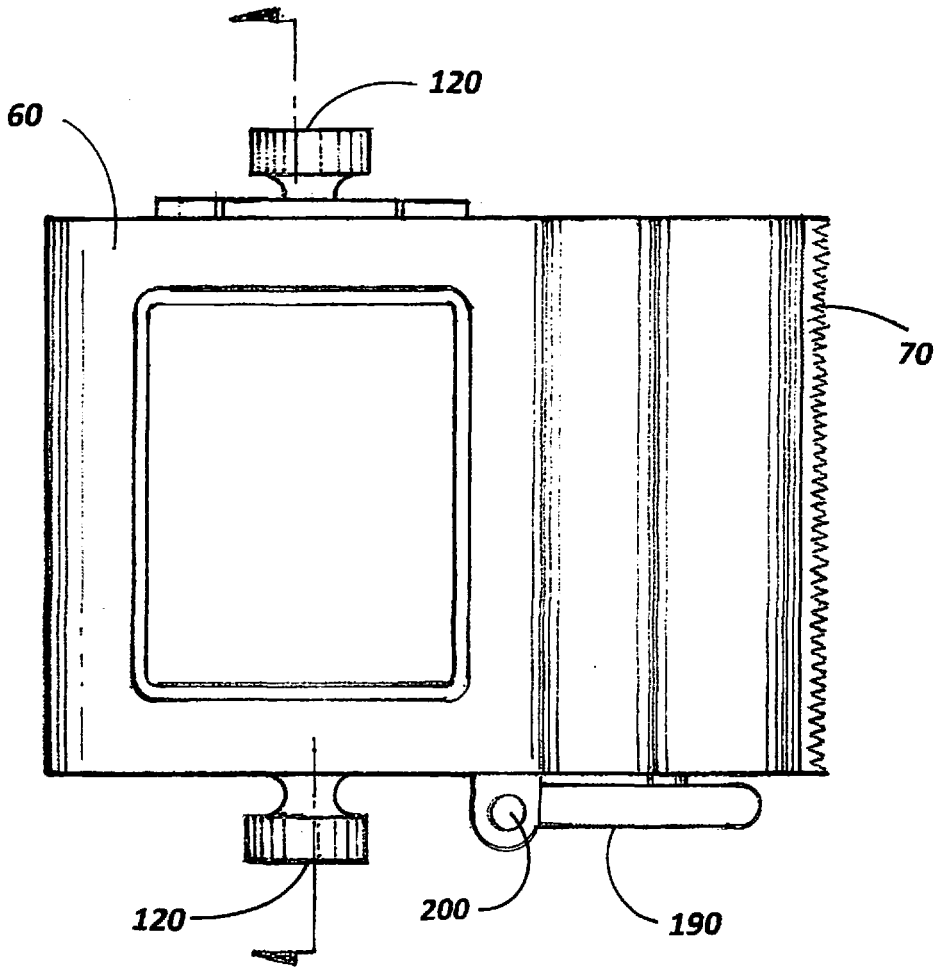
FIG. 4 is a top plan view of the invention.

FIGS. 1-3 illustrate a dispensing aid 10 for attachment to an annular roll 20 of tape 30 that has an inside radial surface 22 and an outer radial tape surface 28, such as a roll of masking tape for example. A pair of side risers 40 each have at a lower end 42 thereof an opposing, inwardly-projecting tab 50 that is configured for sliding along the inside radial surface 22 of the roll 20 of tape 30. Preferably at least one of the tabs 50 is arched at a top surface 58 thereof in order to accommodate the curvature of the inside radial surface 22 of the roll 20 (FIGS. 3 and 5).

A top platform 60 laterally spans the outer radial tape surface 28 width W (FIG. 5) and is fixed with an upper end 48 of each riser 40. In one embodiment, the distance D between each riser 40 is adjustable through a slot in the platform 60, the detent 130 allowing the selected distance D to be locked when the riser is in the vertical closed position 110, thereby accommodating a variety of tape 30 widths W. Alternately, the distance D may be fixed. A cutting blade 70 projects away from the top platform 60 at a forward end 69 of the platform 60.

Figure 5:
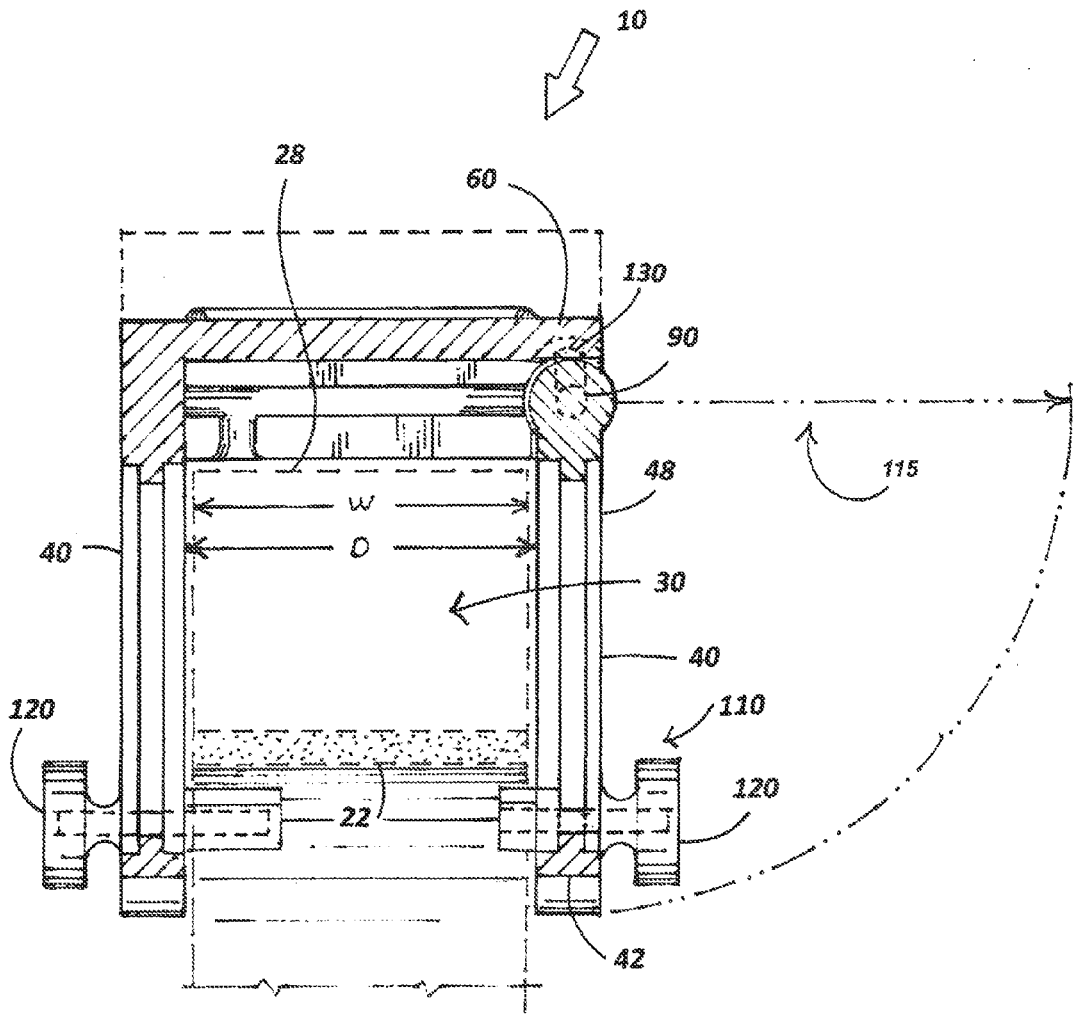
FIG. 5 is a cross-sectional view of the invention, taken along the section lines of FIG. 6.
Figure 6:
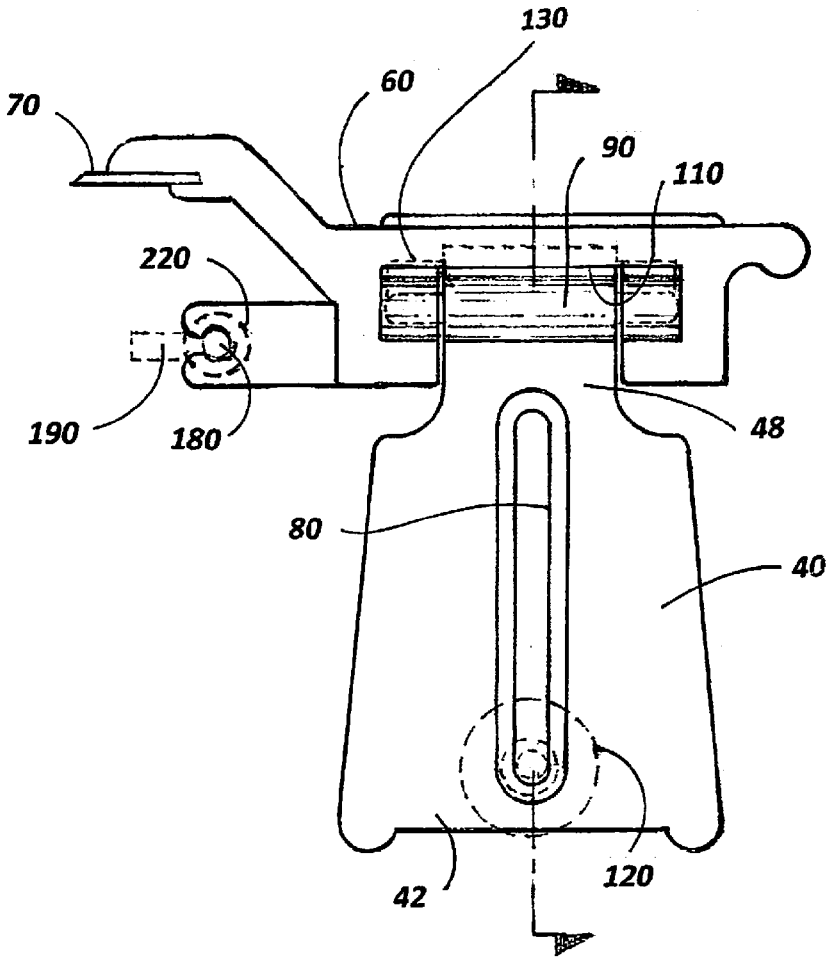
FIG. 6 is a left-side elevational view of the invention.

In one embodiment, at least one of the risers 40 includes a central slot 80, and the tab 50 associated with such a riser 40 is slidably engaged within the slot 80 (FIGS. 5 and 6). As such, the tab 50 may be positioned closer to the top platform 60 as the tape 30 is used up on the roll 20 so as to keep the top platform 60 properly positioned substantially tangentially to the roll 20 (FIG. 3). A thumb screw 120 may be further include, the thumb screw 120 being threadably traversable through the tab 50 and configured to selectively squeeze the riser 40 between the thumb screw 120 and the tab 50 for fixing the relative vertical location of the tab 50 on the riser 40.

Further, at least one such riser 40 may include a pivot bar 90 at the upper end 48 thereof, the top platform 60 including a pivot bar receiver 100 for receiving the pivot bar 90. As such, the riser 40 may pivot from a vertical closed position 110 (FIG. 5) to a horizontal open position 115, thereby facilitating the attachment and removal of the aid 10 with the roll 20. Preferably the pivot bar 90 and pivot bar receiver 100 include a detent 130 cooperative to urge the riser 40 to remain in the vertical closed position 110 unless significant force is used to overcome the detent 130 to pivot the riser 40 towards the open position 115, thereby keeping the riser 40 from pivoting inadvertently.

A tape end retaining post 180 (FIGS. 1 and 2) may be fixed between two forwardly-projecting prongs 190 and adapted for temporarily retaining the end of the tape 30 thereon once cut by the cutting blade 70. One of the prongs 190 may be pivotally fixed with the top platform 60, and the opposing prong 190 may be selectively detachable at a snap mechanism 210 (FIG. 1) from the retaining post 180, such that the retaining post 180 may be pivoted away from the top platform at a pivot 200 to facilitate the positioning of the end of the tape 30 between the top platform 60 and the retaining post 180. Further, a roller 220 may be rotationally fixed around the post 180 for facilitating removal of the end of the tape 30 when the tape 30 is fixed thereto.

In use, with the aid 10 fixed about the roll 20, a piece of tape 30 may be pulled away from the roll 20 and cut with the cutting blade 70. The aid 10 is slidable around the perimeter of the tape roll 20 to a position ready for cutting a subsequent piece of tape 30. Preferably the aid 10 is made from a plastic injection-molded material, with the possible exception of the cutting blade 70 that may be made from a metallic material, for example.

While a particular form of the invention has been illustrated and described, it will be apparent that various modifications can be made without departing from the spirit and scope of the invention. For example, while the illustrations depict the aid 10 used with masking tape 30, other types of tape rolls 20 may be accommodated by modifying the size of the aid 10. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A dispensing aid for attachment to an annular roll of tape having an inside radial surface and an outer radial tape surface, comprising:

a pair of side risers having at lower ends thereof opposing, inwardly-projecting tabs configured for sliding along the inside radial surface of the roll of tape;

a top platform laterally spanning the outer radial tape surface, each riser fixed therewith at an upper end of the riser; and a cutting blade projecting away from the top platform at a forward end thereof;

at least one of the risers including a central slot, and wherein the tab of the riser is slidably engaged within the slot, whereby the tab may be positioned closer to the top platform as the tape is used up on the roll so as to keep the top platform properly positioned substantially tangentially to the roll;

at least one of the risers with the slot further including a pivot bar at the upper end thereof, the top platform including a pivot bar receiver for receiving the pivot bar, such that the riser may pivot from a vertical closed position to a horizontal open position;

whereby with the aid fixed about the roll of tape, a piece of tape may be pulled away from the roll and cut with the cutting blade, the aid slidable around the perimeter of the tape roll to a position ready for cutting a subsequent piece of tape.

2. The dispensing aid of claim 1 wherein at least one of the tabs is arched at a top surface thereof to accommodate the curvature of the inside radial surface of the roll of tape.

3. The dispensing aid of claim 1 wherein the pivot receiver of the top platform includes a detent for urging the riser once in the vertical closed position to remain in the vertical closed position.

4. A dispensing aid for attachment to an annular roll of tape having an inside radial surface and an outer radial tape surface, comprising:

a pair of side risers having at lower ends thereof opposing, inwardly-projecting tabs configured for sliding along the inside radial surface of the roll of tape;

a top platform laterally spanning the outer radial tape surface, each riser fixed therewith at an upper end of the riser;

a cutting blade projecting away from the top platform at a forward end thereof; and a tape end retaining post fixed between two forwardly-projecting prongs and adapted for retaining the end of the tape thereon once cut by the cutting blade;

whereby with the aid fixed about the roll of tape, a piece of tape may be pulled away from the roll and cut with the cutting blade, the aid slidable around the perimeter of the tape roll to a position ready for cutting a subsequent piece of tape.

5. The dispensing aid of claim 4 wherein one of the prongs is pivotally fixed with the top platform and wherein the opposing prong is selectively detachable from the retaining post, whereby the retaining post may be pivoted away from the top platform to facilitate the positioning of the end of the tape between the top platform and the retaining post.

6. The dispensing aid of claim 4 wherein a roller is rotationally fixed around the post for facilitating removal of the end of the tape when the tape is affixed thereto.

* * * * *